US008662341B2

(12) United States Patent
Kohen

(10) Patent No.: US 8,662,341 B2
(45) Date of Patent: Mar. 4, 2014

(54) WAVE PREVENTING FLEXIBLE TANK FOR LIQUIDS

(76) Inventor: Yusuf Kohen, Istanbul (TR)

( * ) Notice: Subject to any disclaimer, the term of this patent is extended or adjusted under 35 U.S.C. 154(b) by 0 days.

(21) Appl. No.: 13/129,143

(22) PCT Filed: Nov. 13, 2009

(86) PCT No.: PCT/TR2009/000141

§ 371 (c)(1),
(2), (4) Date: Jun. 22, 2011

(87) PCT Pub. No.: WO2010/056219

PCT Pub. Date: May 20, 2010

(65) Prior Publication Data

US 2011/0240652 A1 Oct. 6, 2011

(30) Foreign Application Priority Data

Nov. 14, 2008 (TR) ..... u 2008 08670

(51) Int. Cl.
*B65D 25/04* (2006.01)

(52) U.S. Cl.
USPC ..... 220/564

(58) Field of Classification Search
USPC ..... 220/562, 563, 564, 905
See application file for complete search history.

(56) References Cited

U.S. PATENT DOCUMENTS

| | | | | |
|---|---|---|---|---|
| 3,712,502 | A * | 1/1973 | Basier et al. | 220/564 |
| 4,315,531 | A * | 2/1982 | Gerhard | 141/98 |
| 4,875,596 | A | 10/1989 | Lohse | |
| 2003/0044553 | A1 * | 3/2003 | Ramanathan et al. | 428/35.8 |

FOREIGN PATENT DOCUMENTS

| | | |
|---|---|---|
| GB | 2360816 | 2/2004 |
| WO | 2008085141 | 7/2008 |
| WO | 2008135277 | 11/2008 |

* cited by examiner

*Primary Examiner* — Steven A. Reynolds
*Assistant Examiner* — King M Chu
(74) *Attorney, Agent, or Firm* — Gardner Groff Greenwald & Villanueva, PC

(57) ABSTRACT

The present invention is a flexible tank (1) having a closed form wherein liquid can be stored and which can carry liquid from one location to the other by means of a vehicle, characterized in that said flexible tank (1) comprises a plurality of compartments (2) which are coupled with each other so as to comprise a curved form.

6 Claims, 5 Drawing Sheets

WAVE PREVENTING FLEXIBLE TANK FOR LIQUIDS

TECHNICAL FIELD

The present invention relates to a flexible tank used in any liquid fluid transportation; and especially relates to flexible tanks comprising a structure which decreases liquid wave fluctuations inside the tank formed by the affect of the forces resulting from the transportation dependant fluctuations of the vehicle carrying the tank.

THE KNOWN STATE OF THE ART

Especially the solutions provided by the flexible big bags in the transportation of the materials in illiquid granule form are used in practice for years. As in granule type materials, the usage of flexible big bag or in more general terms the flexible carriers in the transportation of liquid/liquid based materials can provide beneficial solutions. As a matter of fact, the technical specifications like liquid transportation, impermeability, the filling of the liquid into the transportation medium, the discharging of the liquid from the transportation medium and the preservation of the hygiene quality of this medium and also other factors like minimizing the possible costs related to transportation are important matters which should be taken into consideration primarily.

A solution for the usage of flexible tanks for the storing and the carrying of the liquids is disclosed in GB 2 360 816. In GB 2 360 816, a flexible tank appropriate for liquid transportation comprising a one piece body formed by a co-extrusion blown film technique is disclosed. This one piece body may comprise an inner and an outer liner component and each component may comprise two to four layers. Two holes formed inside the tank can provide the adaptation of the hose inlet and the pressure discharge valve to the tank.

In EP 0 567 383, a fluid storing system comprising a liner fixed by seaming to a thin walled carrier is disclosed. Since the liner is embodied in greater sizes than the thin walled carrier, the possible tensions in the liner seams are reduced.

In U.S. Pat. No. 4,875,596, a tank which has open ends in the form of a tube wherein liquid materials can be stored and carried and where said ends are seamed tightly by means of straight or line-like clamp connection parts is disclosed. The clamp connection parts are formed toothed rack-like so that, with relatively short clamp connection parts, tubes with relatively large openings can be sealed tightly.

Thus it can be seen that the present applications do not provide a solution which can prevent the liquid inside the tank to produce wave in reaction to the forces resulting from the accelerated or shaking displacement of the land and sea vehicles carrying the flexible tank which is full of liquid.

In practice, it is known that the vehicles carrying the flexible tank which is full of liquid between two locations are truck type land vehicles. In the land vehicles carrying the flexible tank, the wave formation is inevitable inside the flexible tank full of liquid because of the conditions of the road (ditch cuts, disturbances on the road) and because of the acceleration realized by the driver of the vehicle. The hydrodynamic pressure as a result of the waves formed under these conditions reaches to such levels that the seam regions of the components forming the flexible tank is subject to harsh stresses and as a result of this, the tank breaks at the seam regions thereof and the liquid carried is lost.

When the one piece flexible tank disclosed in GB 2 360 816 is taken into consideration, the hydrodynamic pressure levels formed is not as big a danger for the structural integrity of the tank when compared to a seamed formed tank, the stresses formed on the walls of the tank are transferred to the container walls carrying the tank. As a matter of fact, the flexible tank in the application in GB 2 360 816 is in contact with the container walls of the vehicle carrying it and the flexible tank is supported by the container walls. Under these conditions, a container resistant to the dynamic loads formed as a result of the wave fluctuation of the container becomes necessary.

BRIEF DESCRIPTION OF THE INVENTION

In order to eliminate the abovementioned disadvantages, the object of the present invention is to make the tanks more resistant by minimizing the hydrodynamic pressures resulting from the wave fluctuation of the liquids inside the flexible tanks.

The present invention is a flexible tank having a closed form wherein liquid can be stored and which can carry liquid from one location to the other by means of a vehicle, characterized in that said tank comprises a plurality of compartments which are coupled with each other so as to comprise a curved form.

In a preferred embodiment of the present invention, there are apertures between the compartments so as to provide liquid transfer.

In an alternative embodiment of the present invention, there is also a structure which does not let liquid transfer between a plurality of compartments. In this alternative embodiment, the liquid provision and discharge inside each compartment can be provided in a plurality of forms; for instance, the liquid in the tank can be discharged by means of air pressure by providing air from one layer of the tank body formed by a plurality of flexible layers, or by means of a valve aperture opened on the surface of each compartment, the liquid input-output can be provided.

By the separation of the subject matter flexible tank body to a plurality of compartments so as to comprise a curved form, the wave fluctuation length of the liquid in the direction of the tank axis is limited and thus since the liquid inside the tank is divided into parts which are smaller in volume, the hydrodynamic pressure levels formed as a result of the waves are decreased.

According to the arrangement of the subject matter invention, an outlet arrangement is given arranged in the valve part where the liquid input to and output from the flexible tank is provided. By means of this outlet arrangement, the uncontrolled discharge of the liquid inside the tank as a result of the breakage of the valve is prevented.

BRIEF DESCRIPTION OF THE FIGURES

In order to understand the embodiment of the present invention with the additional elements in the best way, it had to be evaluated with the figures that are explained below.

REFERENCE NUMBERS

Figure 1:
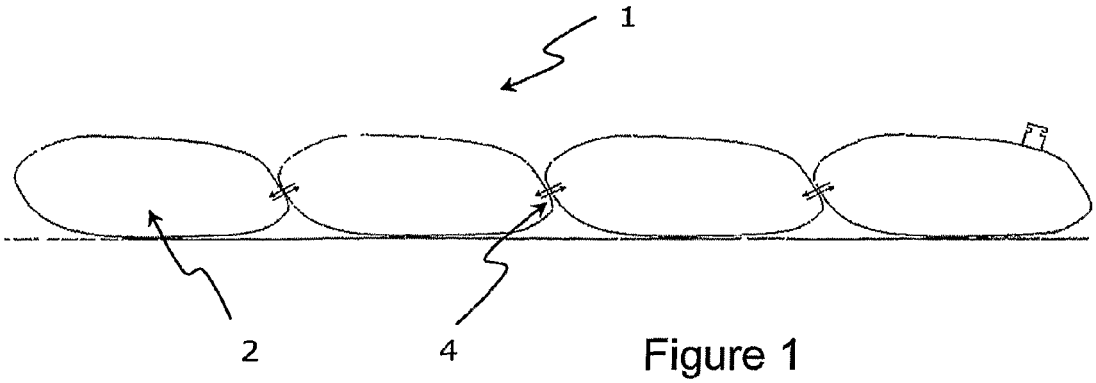
FIG. 1 is the lateral view of the flexible tank separated into compartments according to the present invention.

1 Flexible tank
2 Compartment
3 Passage region or barrier
4 Aperture
5 Valve connection gap
6 Sheath or the outer layer
7 Supporting member
8 Valve inner cover
9 Valve outer cover
10 Seam
11 Inner layers
12 Weld

THE DETAILED DESCRIPTION OF THE INVENTION

FIG. 1 is the perspective view of the flexible tank according to the present invention. The flexible tank body (1) comprises a plurality of compartments (2) connected to each other so as to comprise a curved form. According to the preferred arrangement of the invention, in order to minimize the formation of waves inside the tank, the compartments (2) are connected so as to come on top of each other partially.

Figure 5:
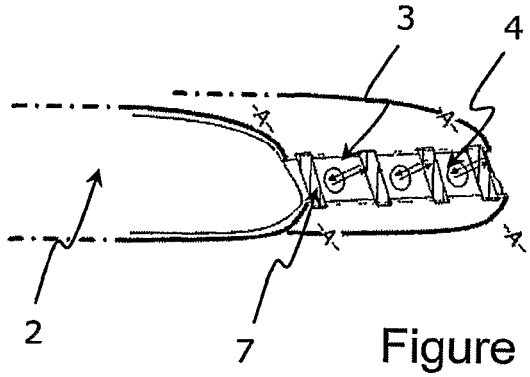
FIG. 5 is the perspective view of the compartment combining surface A-A in FIG. 4.

As can be seen in more details in FIG. 5, the liquid passage between the compartments (2) is provided by means of a plurality of apertures (4) formed between the compartments (2). According to an alternative arrangement, the liquid passage between the compartments (2) can also be provided using a barrier (3) comprising a plurality of apertures.

Figure 2:
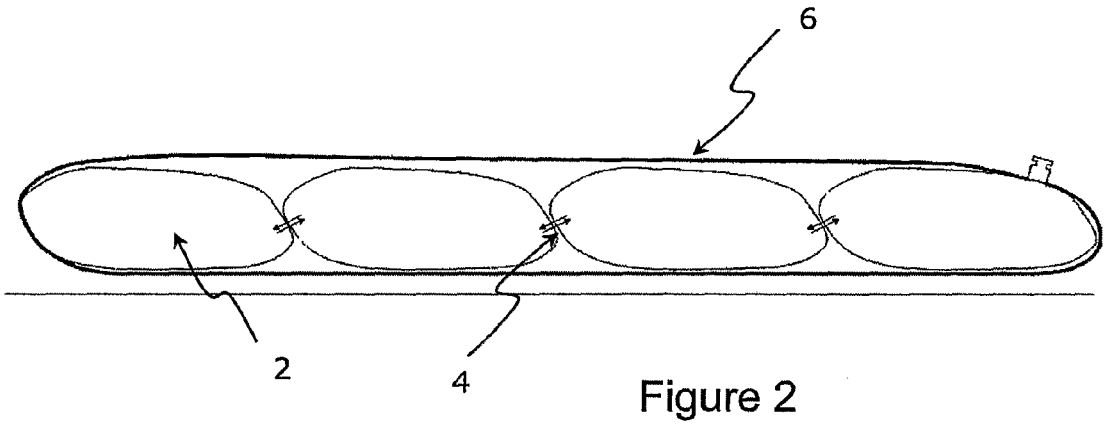
FIG. 2 is the lateral view corresponding to the sheathed condition of the outer surface of the flexible tank separated into compartments according to the present invention.
Figure 3:
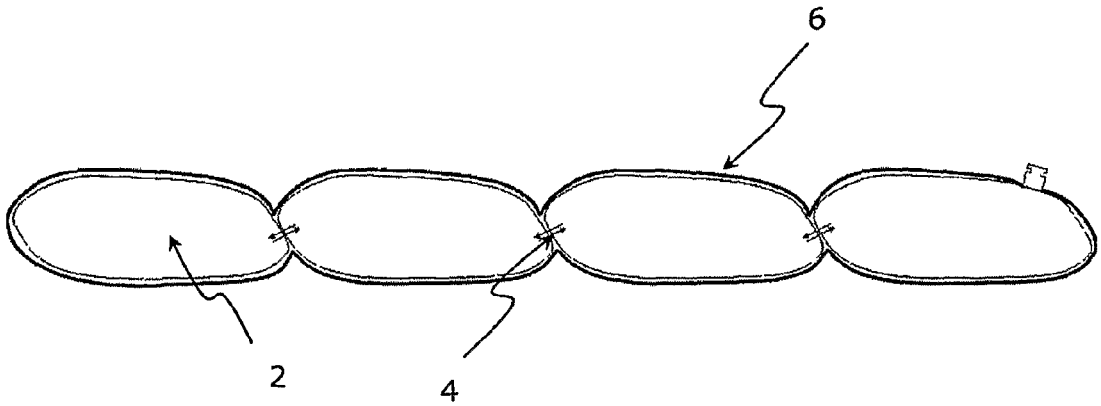
FIG. 3 is the lateral view corresponding to the sheathed and curved condition of the outer surface of the flexible tank separated into compartments according to the present invention.

In FIG. 2, a substantially resistant sheath (6) enclosing the tank in order to protect the tank disclosed in FIG. 1 from the outer affects like friction is illustrated. In FIG. 3, the view of the structure where sheath (6) has the curved form of the compartments is illustrated.

Figure 4:
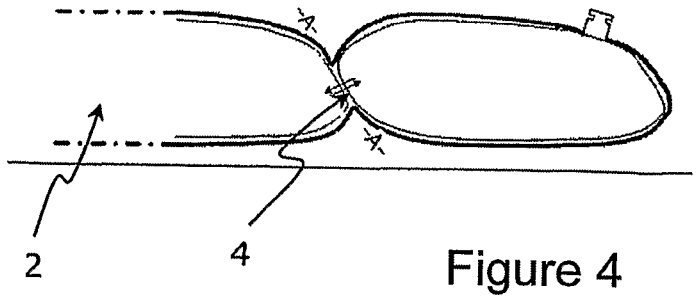
FIG. 4 is the lateral view illustrating the passage of the flexible tank between two compartments according to the present invention.

The connection surface between the compartments illustrated by the A-A line in FIG. 4 is illustrated in FIG. 5. In order for the stresses formed by liquid passage between the compartments (2) not to corrupt the stability of the sheath (6), the sheathes between two side by side compartments (2) are connected by means of a plurality of supporting members (7) from the side regions thereof.

Figure 6:
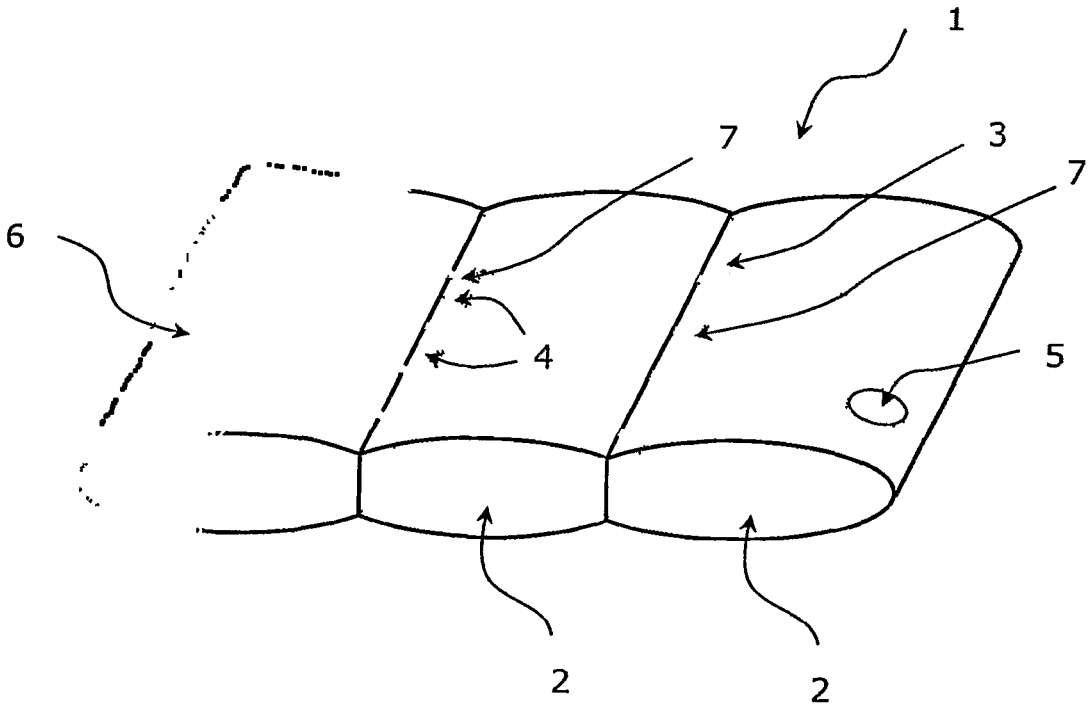
FIG. 6 is the perspective view of the flexible tank separated into compartments according to an alternative arrangement of the invention.

In FIG. 6, the perspective view of the flexible tank arranged according to an alternative arrangement of the invention is given. In this alternative, the flexible tank body (1) is separated into parts comprising a plurality of compartments (2) which are separated by means of passage regions or barriers (3) from each other and which are preferably not brought on top of each other.

In this alternative, the passage regions (if barriers are being used the barriers (3)) comprise a plurality of apertures (4), thus, the liquid passage between the compartments (2) can be provided by means of these apertures (4).

The compartments or the barriers (3) can be fixed to the tank body (1) by means of any method like welding or seaming. The apertures (4) in the preferred embodiment of the invention are illustrated in FIG. 5 or 6 in circular form symbolically, also they can have any desired geometrical shape and the aperture dimensions can be determined in the desired form depending on the working conditions.

Figure 7:
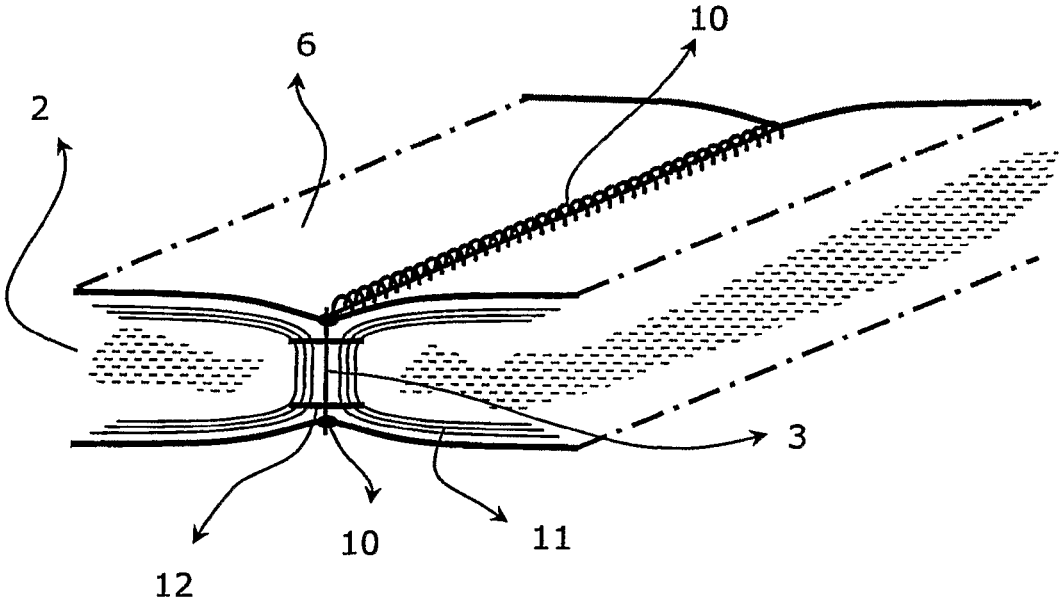
FIG. 7 is the perspective view of the inter compartment combination according to the alternative in FIG. 6.

In FIG. 7, the perspective view of the connection parts of the compartments (2) according to the alternative embodiment of the invention is given. According to the figure, the compartments (2) are combined to each other preferably by means of seams (10). Again according to the preferred arrangement of the invention, at least one inner layer (11) shaped so as to cover each other in the inner part of the outer layer (6) is provided and these inner layers (11) are fixed to each other transversely preferably by means of a weld (12).

While the outer layer (6) is selected from a polypropylene material, the inner layer(s) (11) is/are selected from polyethylene material. It should be appreciated that the compartments and the layers of the invention can not be limited by the abovementioned material and connection methods and that instead of a preferred arrangement, any connection method and material can be substituted known in the art. In the preferred embodiment of the invention, the material of the barriers (3) which can be used optionally is polyethylene.

The barriers (3) have material continuity for instance by means of weaving and they comprise a plurality of apertures (4), and they also may have a structure which is formed by adapting parts like cord which have a certain thickness to the inner surface, thus, a form providing the barrier function between the compartments (2) can be obtained.

Figure 8:
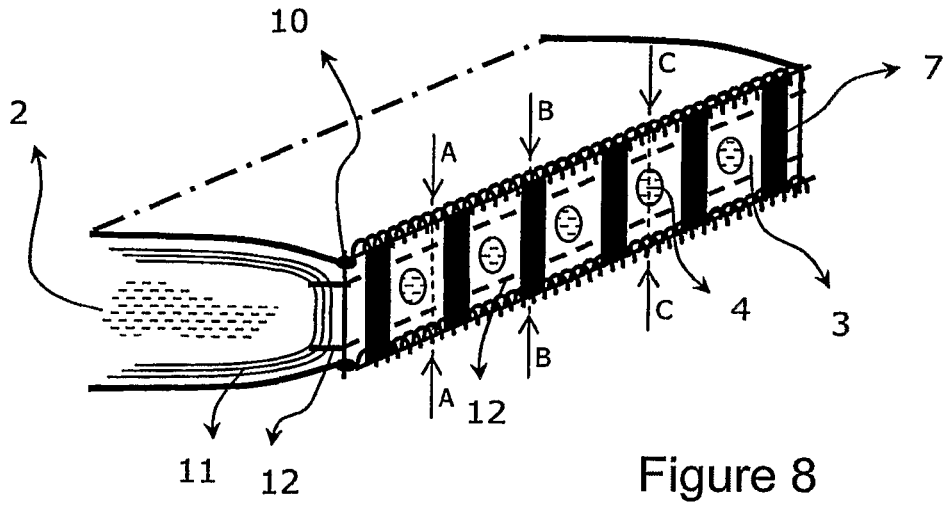
FIG. 8 is the detailed perspective view of the inter compartment combination cross section in FIG. 7.
Figure 9:
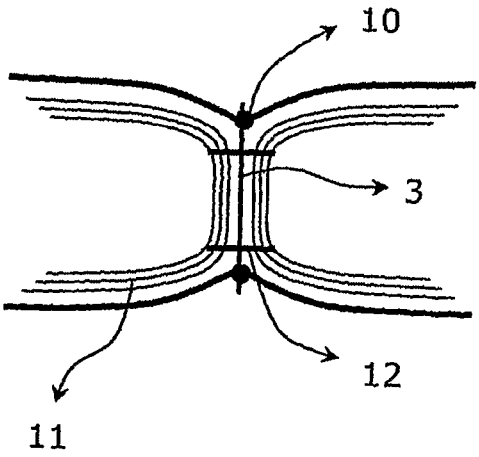
FIG. 9 is the view of the A-A cross section in FIG. 8.

In FIG. 9, the view of the A-A section in FIG. 8 is given. In the A-A cross section, the seams (10) connecting the compartments (2) to each other, the passage region or the barrier (3) and the weld (12) connecting the inner layers (11) to each other in the connection region are illustrated.

Figure 10:
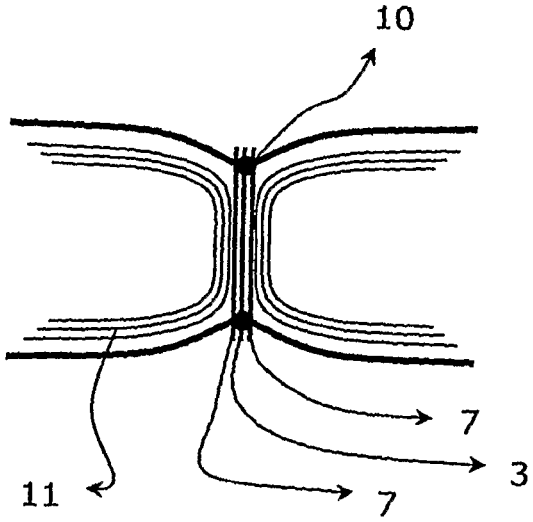
FIG. 10 is the view of the B-B cross section in FIG. 8.
Figure 11:
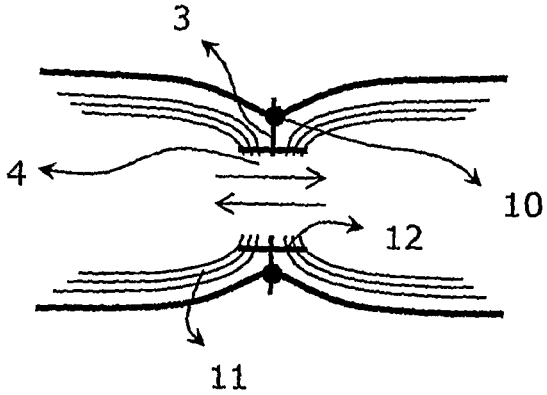
FIG. 11 is the view of the C-C cross section in FIG. 8.

In FIG. 10, the view of the C-C cross section in FIG. 8 is given. In the C-C cross section, the apertures (4) providing material passage between the compartments (2) and the weld (12) connecting the inner layers (11) in the connection region and barrier (3) or passage region are illustrated.

In an appropriate region on the flexible tank body (1), an aperture (5) is formed in order to provide water input to and discharge from the body by means of a valve. Said valve comprises a tab projecting in pipe shape from the flexible tank body.

Figure 13:
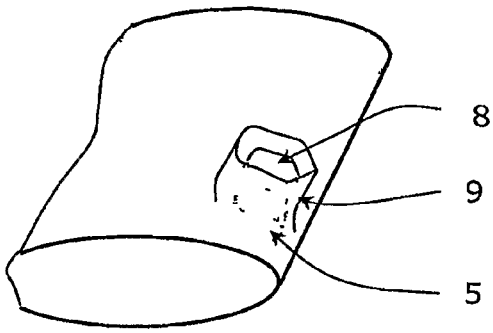
FIG. 13 is the view of the valve structure providing the liquid input to the flexible tank.

As can be seen in FIG. 13, there is preferably an inner cover (8) and an outer cover (9) provided so as to cover the valve's tab in pipe shape projecting outwards where the valve is adapted to the aperture (5) arranged on the tank body. In a preferred embodiment of the invention, the inner cover (8) is fixed to the tank body and the outer cover (9) is fixed to the sheath (6). In practice, after filling the tank with liquid, the inlet part of the inner cover (8) is closed and it is folded towards the valve after twisting like a swan's neck. Afterwards, the outer cover (9) is squeezed at the inlet part and thus the connection is completed so that the inner cover (8) is inside the outer cover (9). Said last arrangement alternatively can be embodied so as to comprise only one cover. In this case, the cover member can be integral to the body (1) or all (or the side parts) can be an independent member like latex providing self stretch. This arrangement covered by the invention can also be used for other flexible tanks which are used for liquid carrying and which do not comprise compartment.

Figure 12:
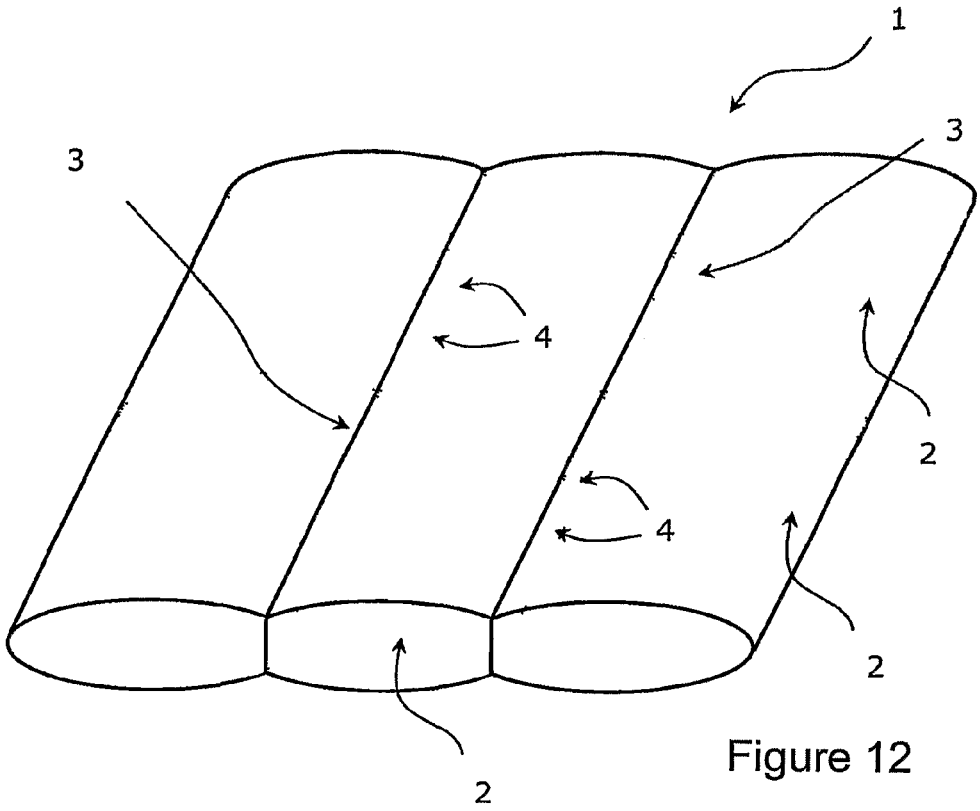
FIG. 12 is the perspective view of the structure with compartments extending along the tank axis and width according to the present invention.

According to another alternative embodiment of the invention, the compartments (2) can also be formed in the transverse direction of the tank body (1) (FIG. 12). In this case, the increase in hydrostatic pressure resulting from the wave fluctuation formed along the tank axis is decreased by means of compartments and the increase in hydrostatic pressure resulting from the wave fluctuation in the transverse direction is decreased by means of compartments in the direction of the width of the tank.

The invention claimed is:

1. A flexible tank for storing and carrying liquid, the flexible tank having a closed form wherein the liquid can be stored and which can carry the liquid from one location to the other by means of a vehicle, wherein said flexible tank comprises a plurality of separably enclosed compartments where a plurality of apertures is formed therebetween to provide liquid passage and which are coupled with respect to each other by means of a stitch seam in order to comprise a curved form and to be superposed partially one above another.

2. The flexible tank of claim 1, further comprising: at least one passage region or barrier positioned between said plurality of compartments, wherein the plurality of compartments are positioned side by side and spaced apart; and a plurality of supporting members positioned between the plurality of apertures.

3. The flexible tank of claim 1, further comprising at least one inner layer comprising polyethylene.

4. The flexible tank of claim 1, further comprising a sheath outer layer with a substantial strength covering the outer surface of said tank, wherein the sheath outer layer comprises polypropylene.

5. A flexible tank for storing and carrying liquid, the flexible tank comprising;

a closed form, wherein the liquid can be stored and which can carry the liquid from one location to the other by means of a vehicle, wherein said flexible tank comprises a plurality of compartments coupled with respect to each other in order to comprise a curved form and to be superposed partially one above another;

at least one passage region or barrier comprising a plurality of apertures, wherein the at least one passage region or barrier is provided between said plurality of compartments;

at least one vertical supporting member secured with respect to the at least one passage region or barrier between said plurality of compartments; and at least one sheath outer layer covering the plurality of compartments, wherein the at least one sheath outer layer is secured with respect to the at least one vertical supporting member.

6. A flexible tank for storing and transporting liquid, the flexible tank comprising a closed form wherein the liquid can be stored and which can carry the liquid from one location to the other by means of a vehicle, wherein said flexible tank comprises a plurality of separably enclosed compartments coupled with respect to each other in order to comprise a curved form and so as to be superposed partially one above another, wherein the plurality of separably enclosed compartments comprise a plurality of apertures therebetween to provide liquid passage, wherein the plurality of compartments are configured to reduce hydrostatic pressure caused by transverse movement of the liquid with respect to the flexible tank and further comprising at least one vertical supporting member secured with respect to the at least one passage region or barrier between said plurality of compartments.

* * * * *